US009903564B2

(12) United States Patent
Pijlman et al.

(10) Patent No.: US 9,903,564 B2
(45) Date of Patent: Feb. 27, 2018

(54) LAMP AS WELL AS A METHOD FOR USING SUCH A LAMP

(71) Applicant: PHILIPS LIGHTING HOLDING B.V., Eindhoven (NL)

(72) Inventors: Fetze Pijlman, Eindhoven (NL); Peter Tjin Sjoe Kong Tsang, Eindhoven (NL); Michel Cornelis Josephus Marie Vissenberg, Eindhoven (NL)

(73) Assignee: PHILIPS LIGHTING HOLDINGS B.V., Eindhoven (NL)

( * ) Notice: Subject to any disclaimer, the term of this patent is extended or adjusted under 35 U.S.C. 154(b) by 0 days.

(21) Appl. No.: 15/110,240

(22) PCT Filed: Dec. 11, 2014

(86) PCT No.: PCT/EP2014/077445
§ 371 (c)(1),
(2) Date: Jul. 7, 2016

(87) PCT Pub. No.: WO2015/104135
PCT Pub. Date: Jul. 16, 2015

(65) Prior Publication Data

US 2016/0327245 A1 Nov. 10, 2016

(30) Foreign Application Priority Data

Jan. 13, 2014 (EP) ..... 14150894

(51) Int. Cl.
*F21V 9/14* (2006.01)
*F21V 14/08* (2006.01)
(Continued)

(52) U.S. Cl.
CPC ..... *F21V 14/08* (2013.01); *F21K 9/64* (2016.08); *F21S 48/1757* (2013.01); *F21V 5/04* (2013.01);
(Continued)

(58) Field of Classification Search
CPC ... F21V 14/08; F21V 9/64; F21V 9/14; F21V 9/16; F21S 48/1757; F21S 23/003; G02B 26/008
(Continued)

(56) References Cited

U.S. PATENT DOCUMENTS 7,547,114 B2 6/2009 Li et al.
2007/0019408 A1* 1/2007 McGuire, Jr. ..... F21S 10/007 362/231
(Continued)

FOREIGN PATENT DOCUMENTS

DE 102012208566 A1 11/2013
JP 2006138939 A 6/2006
(Continued)

*Primary Examiner* — Laura Gudorf

(57) ABSTRACT

A lamp comprising at least one light source adapted for emitting optical radiation, at least one scanning mirror, a fluorescent body and optical means for transmitting at least a portion of the optical radiation being directed from the light source by the scanning mirror onto the fluorescent body to an output of the lamp. The fluorescent body is plate-shaped, whilst the optical means comprises at least one lens, wherein each part of the plate-shaped fluorescent body can be imaged by the at least one lens in a predetermined direction to the output of the lamp.

18 Claims, 7 Drawing Sheets

(51) Int. Cl.

| | |
|---|---|
| ***F21V 9/16*** | (2006.01) |
| ***F21S 8/10*** | (2006.01) |
| ***F21K 9/64*** | (2016.01) |
| ***F21V 5/04*** | (2006.01) |
| ***F21V 23/00*** | (2015.01) |

(52) U.S. Cl.
CPC ..... *F21V 9/14* (2013.01); *F21V 9/16* (2013.01); *F21V 23/003* (2013.01)

(58) Field of Classification Search
USPC ..... 362/84
See application file for complete search history.

(56) References Cited

U.S. PATENT DOCUMENTS

| | | | | |
|---|---|---|---|---|
| 2010/0102211 | A1* | 4/2010 | Murooka | A61B 1/0638 250/226 |
| 2011/0211333 | A1* | 9/2011 | Bartlett | G03B 21/204 362/84 |
| 2011/0249460 | A1 | 10/2011 | Kushimoto | |
| 2013/0271947 | A1 | 10/2013 | Finsterbusch et al. | |
| 2014/0029237 | A1* | 1/2014 | Mehl | F21V 9/08 362/84 |

FOREIGN PATENT DOCUMENTS

| | | | |
|---|---|---|---|
| JP | 2012209228 | A | 10/2012 |
| JP | 2013092752 | A | 5/2013 |
| WO | WO2013099144 | A1 | 7/2013 |
| WO | WO2013187145 | A1 | 12/2013 |

* cited by examiner

LAMP AS WELL AS A METHOD FOR USING SUCH A LAMP

CROSS-REFERENCE TO PRIOR APPLICATIONS

This application is the U.S. National Phase application under 35 U.S.C. § 371 of International Application No. PCT/EP2014/077445, filed on Dec. 11, 2014, which claims the benefit of European Patent Application No. 14150894.5, filed on Jan. 13, 2014. These applications are hereby incorporated by reference herein.

FIELD OF THE INVENTION

The invention relates to a lamp comprising at least one light source adapted for emitting optical radiation, at least one scanning mirror, a fluorescent body and optical means for transmitting at least a portion of the optical radiation being directed from the light source by the scanning mirror onto the fluorescent body to an output of the lamp.

The invention also relates to a method for using such a lamp.

BACKGROUND OF THE INVENTION

US20120026721A1 discloses a lamp comprising a laser, a fluorescent body and a parabolic reflector, wherein optical radiation emitted by the laser is converted by the fluorescent body into visible light, which visible light is reflected by the parabolic reflector to an output of the lamp. The fluorescent body comprises a longitudinal cylindrical-shaped body. By the lamp according to US20120026721A1 the laser may comprise a scanning mirror for scanning or widening the laser beam over the fluorescent body resulting in slight changes in the beam profile.

By the lamp according to US20120026721A1 the beam profile can only be slightly changed. With the slightly changes, the collimation of the beam can be slightly adapted. The center of the beam can not be adjusted and the beam can also not be split into several beams.

US2011249460A1 dislcoses a lamp comprising two blue lasers emitting radiation towards two MEMS mirrors, which reflect said radiation corresponding to a prescribed light distribution pattern onto a phosphor panel, which pattern subsequently is projected in a light emitting direction via a projector lens.

SUMMARY OF THE INVENTION

In view of the above-mentioned and other drawbacks of the prior art, a general object of the present invention is to provide a lamp for creating a redirectable spot or relatively complex light beam formations such as squares, logo's etc.

According to a first aspect, the invention provides a lamp wherein the fluorescent body is plate-shaped, whilst the optical means comprises at least one lens, wherein each part of the plate-shaped fluorescent body can be imaged by the at least one lens in a predetermined direction to the output of the lamp wherein the plate-shaped fluorescent body is rotatable about a central axis extending perpendicular to the plate-shaped fluorescent body, wherein the central axis coincides with the optical axis of the at least one lens.

By means of the at least one scanning mirror, the optical radiation of the light source can be directed to each part of the plate-shaped fluorescent body. On the plate-shaped fluorescent body the optical radiation of the light source is converted into visible light. By the at least one lens, the part of the plate-shaped fluorescent body is being imaged in a predetermined direction to the output of the lamp.

By sequentially directing the optical radiation of the light source with the at least one scanning mirror to different predetermined parts of the plate-shaped fluorescent body a desired relatively complex light beam formation such as squares, logo's etc. can be created.

It is also possible to direct the optical radiation of the light source with the at least one scanning mirror continuously to only a relatively small predetermined part of the plate-shaped fluorescent body, whereby a light spot is being created. The spot can be redirected by directing the optical radiation of the light source with the at least one scanning mirror to another relatively small predetermined part of the plate-shaped fluorescent body.

In case that the optical radiation of the light source is directed with the at least one scanning mirror to a specific position on the plate-shaped fluorescent body, the part of the plate-shaped fluorescent body on said specific position may be heated up too much leading to a reduction of the life time of the lamp. By rotating the plate-shaped fluorescent body the optical radiation of the light source is still directed with the at least one scanning mirror to the same specific position but will illuminate different parts on the same radius of the plate-shaped fluorescent body, whereby the heat will be spread over the radius.

According to a further aspect, the invention provides a lamp wherein the plate-shaped fluorescent body is transmissive, whereby optical radiation from the light source is being transmitted through the plate-shaped fluorescent body to the at least one lens.

With a transmissive plate-shaped fluorescent body, the construction of the lamp is relatively simple, wherein an optical axes of light source, fluorescent body and the at least one lens can be coaxially located.

According to a further aspect, the invention provides a lamp wherein on a side of the plate-shaped fluorescent body optically directed towards the light source a reflective polarization filter is located.

When using a light source with polarized light, a part of the polarized light will be transmitted through the transmissive plate-shaped fluorescent body whilst another part will be reflected by the fluorescent body towards the light source. The reflected light will be unpolarized. By using a reflective polarization filter the reflected unpolarized light will be partly reflected by the polarization filter and will still be transmitted through the fluorescent body. In this way loss of optical radiation is being reduced.

According to a further aspect, the invention provides a lamp wherein the light source is adapted for emitting right-handed or left-handed circularly polarized optical radiation, wherein the reflective polarization filter is a reflective circular polarization filter.

When rotating the fluorescent body together with reflective circular polarization filter, a part of the circularly polarized optical radiation will be transmitted through the reflective circular polarization filter and the fluorescent body, whilst another part will be reflected by the fluorescent body towards the light source. The reflected optical radiation will be unpolarized. The reflected unpolarized optical radiation will be partly reflected by the polarization filter and will still be transmitted through the fluorescent body.

According to a further aspect, the invention provides a lamp wherein on a side of the plate-shaped fluorescent body optically directed towards the light source a dichroic filter is located.

By such a dichroic filter optical radiation reflected by the fluorescent body towards the light source will be reflected by dichroic filter towards the fluorescent body and will still be transmitted through the fluorescent body.

According to a further aspect, the invention provides a lamp wherein the plate-shaped fluorescent body is reflective, whereby optical radiation from the light source is being reflected by the plate-shaped fluorescent body to the at least one lens.

With a reflective fluorescent body nearly all optical radiation will be reflected towards the at least one lens and nearly no optical radiation will be lost in the fluorescent body.

According to a further aspect, the invention provides a lamp wherein the light source is optically located on a first side of the plate-shaped fluorescent body, whilst the at least one lens is optically located on a second side of the plate-shaped fluorescent body, wherein the plate-shaped fluorescent body is provided with an aperture for guiding optical radiation emitted by the light source from the first side to the second side.

Due to said aperture a plate-shaped fluorescent body being reflective at the second side can be used whilst the light source is located on the first side, providing a relatively simple lamp.

According to a further aspect, the invention provides a lamp wherein the at least one scanning mirror is located between the at least one lens and the second side.

The optical radiation emitted by the light source will firstly pass the aperture after it is being directed by the at least one scanning mirror to the desired parts on the fluorescent body. In this manner the aperture can be relatively small.

According to a further aspect, the invention provides a lamp wherein the at least one scanning mirror is located at the fist side, whilst an additional mirror is located between the at least one lens and the second side.

In this manner the at least one scanning mirror can be located relatively close to the light source for mechanical simplicity.

According to a further aspect, the invention provides a lamp wherein the plate-shaped fluorescent body is provided with phosphor.

Phosphor can easily be applied to a plate-shaped element to obtain the plate-shaped fluorescent body. Furthermore, with phosphor optical radiation from a light source, for example a laser, can easily be converted into light with a desired wavelength.

According to a further aspect, the invention provides a lamp wherein the plate-shaped fluorescent body is provided with different phosphors in a predetermined pattern.

By means of the at least one scanning mirror, the optical radiation of the light source can be directed to the desired phosphor for generating for example a specific colour. When the plate-shaped fluorescent body is being rotated, the part with the desired phosphor can be moved to the desired position before being illuminated.

According to a further aspect, the invention provides a lamp wherein the light source is a blue laser or a UV laser.

Such a light source provided light with a relatively high colour rendering index (CRI) and are easily available at reasonable costs.

According to a further aspect, the invention provides a lamp wherein the light source can be modulated in intensity.

In this manner it is possible to obtain modulated optical radiation to enable for example multiple different light beams or the possibility to write complex light patterns.

According to a further aspect, the invention provides a lamp wherein the wavelength of the optical radiation emitted by the light source is adjustable.

In this manner different conversion will occur on the fluorescent body depending on the wavelength of the optical radiation and different colour temperatures can be obtained, for example to obtain cold or warm white light.

According to a further aspect, the invention provides a lamp wherein the lamp comprises a control device for controlling the laser, the at least one scanning mirror and/or rotation of the plate-shaped fluorescent body about a central axis extending perpendicular to the plate-shaped fluorescent body, wherein the central axis coincides with the optical axis of the at least one lens.

By means of the control device the wavelength of the light source can be adjusted and/or the intensity of the light source can be modulated. Furthermore by means of the control device the movements of the at least scanning mirror for scanning the optical radiation to each desired part of the plate-shaped fluorescent body can be controlled. When the plate-shaped fluorescent body is being rotated, the rotation in frequency and position can be controlled by the control device and can be synchronized with the control of the light source and the at least scanning mirror so that to at each position a desired optical radiation with the desired wavelength and being modulated in intensity can be directed, whilst at the desired position due to rotation of the fluorescent body a part of the fluorescent body can be present with the desired phosphor.

According to a further aspect, the invention provides a method for using a lamp comprising the steps:

a) emitting optical radiation by a light source, and b) transmitting at least a portion of optical radiation via at least one scanning mirror, a plate-shaped fluorescent body and at least one lens to an output of a lamp.

Due to this method a redirectable spot or relatively complex light beam formations such as squares, logo's etc. can be created.

BRIEF DESCRIPTION OF THE DRAWINGS

These and other aspects of the invention will now be described in more detail, with reference to the appended drawings showing currently preferred embodiments of the inventions, wherein.

In the drawings, like reference numerals refer to like elements.

DESCRIPTION OF PREFERRED EMBODIMENTS

Figure 1:
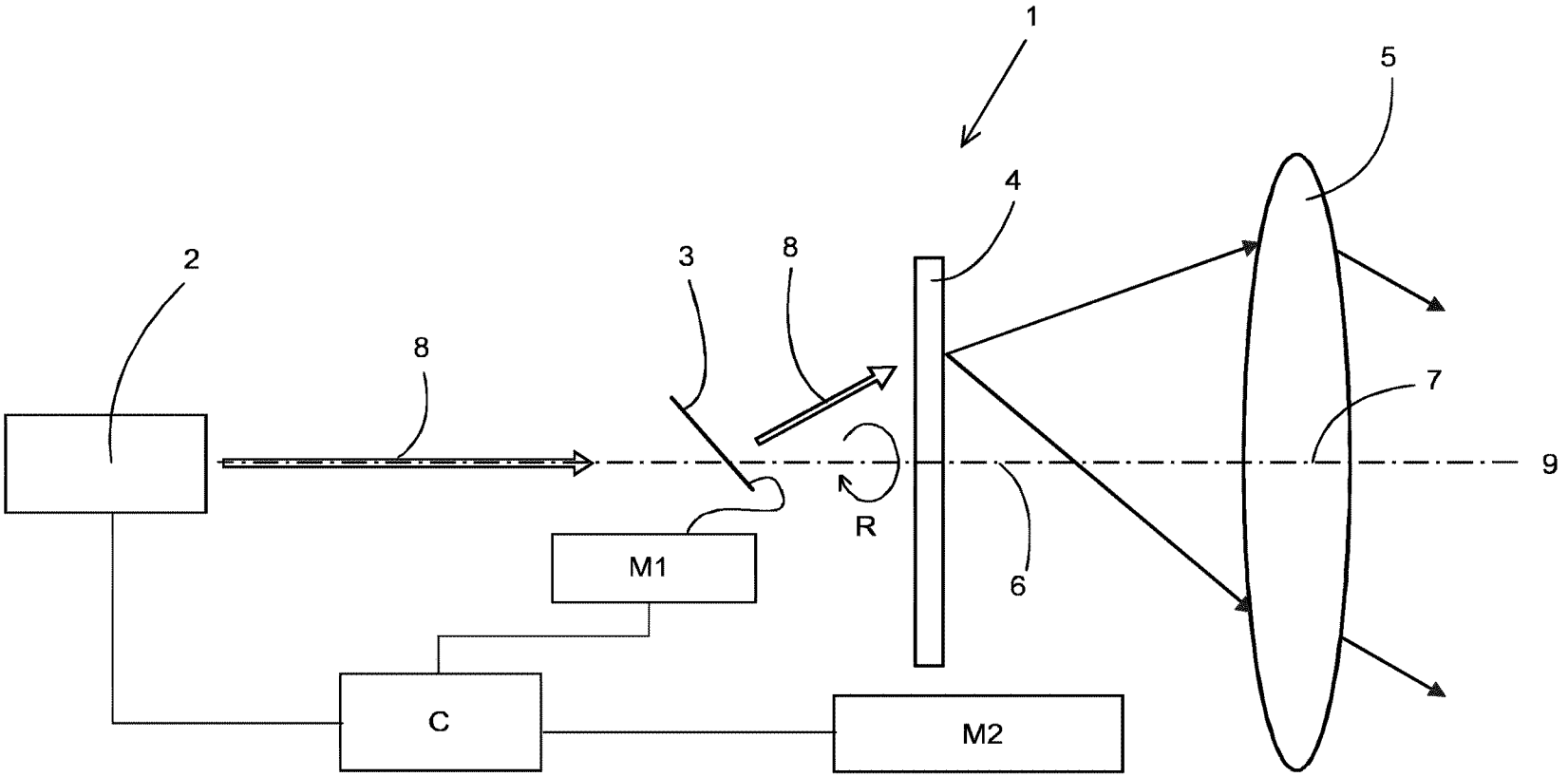
FIG. 1 shows a schematic view of a first embodiment of a lamp according to the invention with a transmissive plate-shaped fluorescent body.

FIG. 1 shows a schematic view of a first embodiment of a lamp 1 according to the invention comprising a light source 2, at least one scanning mirror 3 being driven by at least one motor M1, a plate-shaped fluorescent body 4 and at least one lens 5. The plate-shaped fluorescent body 4 is rotatable by means of a motor M2 in the direction as indicated by arrow R bout a rotating axis 6. The rotating axis 6 extends perpendicular to the plate-shaped fluorescent body 4.

For sake of simplicity only scanning mirror 3 and only one motor M1 is being shown but a person skilled in the art will realize that any desired set of scanning mirrors with a number of motors can be used to move optical radiation emitted by the light source 2 to any desired location on the plate-shaped fluorescent body 4.

The plate-shaped fluorescent body 4 is transmissive for optical radiation emitted by the light source 2.

For sake of simplicity only one lens 5 is being shown but a person skilled in the art will realize that any desired set of lenses can be used. The rotating axis 6 is coaxial with the optical axis 7 of the lens 5.

The light source 2 is a laser with adjustable wavelengths and modulated intensity. The light source 2 is being controlled by control device C. The motors M1, M2 of the scanning mirror 3 and the rotatable plate-shaped fluorescent body 4 are also controlled by control device C.

The plate-shaped fluorescent body 4 is provided with different phosphors in a predetermined pattern.

When operating the lamp 1 according to the invention the light source 2 emits optical radiation with the desired wavelength and intensity towards the scanning mirror 3. The light beam 8 comprising the optical radiation has a diameter for example 1 millimeter. By means of the scanning mirror 3 the light beam 8 is directed towards a desired position on plate-shaped fluorescent body 4, which will be imaged by means of the lens 5 towards an output 9 of the lamp 1. The desired position is a position with predetermined coordinates with respect to for example the light source 2 or the lens 5 and is independently of the angle of rotation of the plate-shaped fluorescent body 4. By controlling the rotation of the he plate-shaped fluorescent body 4 a part of the plate-shaped fluorescent body 4 with the desired phosphor pattern can be moved towards the desired position so that the light beam 8 hits said desired part of the plate-shaped fluorescent body 4. The illuminated part is than imaged by the lens 5 towards the output 9 of the lamp 1.

The plate-shaped fluorescent body 4 has a diameter for example in the range of 1 to 10 centimeter.

By the control device the operation of the light source 2, the scanning mirror 3 and the rotation of the plate-shaped fluorescent body 4 is being controlled so that at each moment at the desired position a desired light beam 8 will hit the plate-shaped fluorescent body 4 at the desired part.

The light source 2 can be scanned over the plate-shaped fluorescent body 4 with a frequency for example in the range of 60-500 Hertz. The plate-shaped fluorescent body 4 can be rotated with a frequency for example in the range of 1-10 Hertz.

The FIGS. 2-7 show schematic view of other embodiments of lamps according to the invention. In these figures the motors M1, M2 and the control device C are not shown but all these embodiments do comprise the motors M1, M2 and the control device C.

Figure 2:
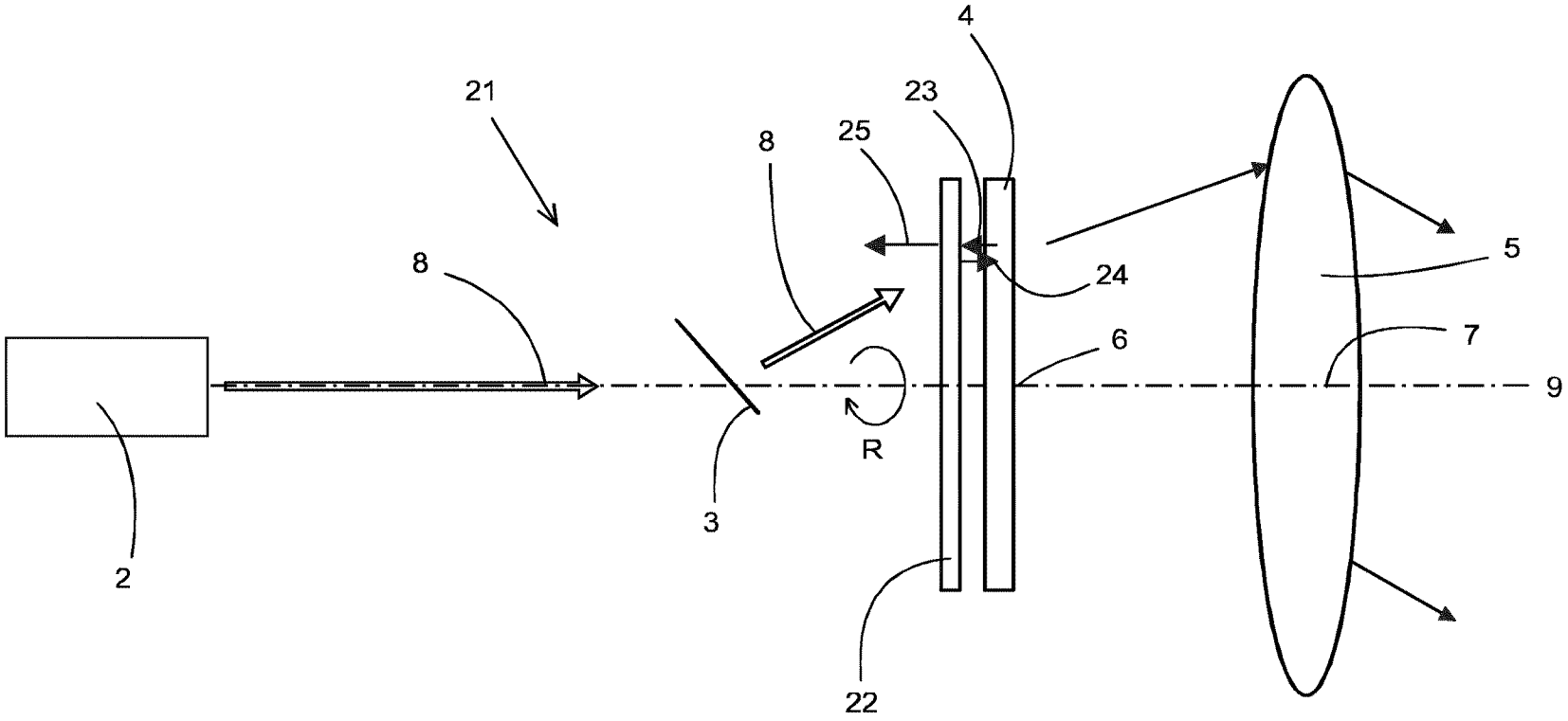
FIG. 2 shows a schematic view of a second embodiment of a lamp according to the invention with a transmissive plate-shaped fluorescent body and a polarization filter.

FIG. 2 shows a schematic view of a second embodiment of a lamp 21 according to the invention, which lamp 21 differs from lamp 1 in that it is provided with a reflective circular polarization filter 22 located on a side of the plate-shaped fluorescent body 4 optically directed towards the light source 2. The reflective circular polarization filter 22 is connected to the plate-shaped fluorescent body 4 at a short distance of less than 1 centimeter thereof and is being rotatable together with the plate-shaped fluorescent body 4 about rotating axis 6 in the direction indicated by arrow R. The light source 2 is adapted for emitting circularly polarized optical radiation being similar right-handed or left-handed as the reflective circular polarization filter 22.

The circularly polarized light beam 8 directed by the scanning mirror 3 to the desired position will pass the reflective circular polarization filter 22 and will be partly transmitted through the plate-shaped fluorescent body 4. A part 23 of the light beam 8 will be reflected by the plate-shaped fluorescent body 4. This part 23 of the light beam 8 is unpolarized and will be reflected by the reflective circular polarization filter 22 as part 24 towards the plate-shaped fluorescent body 4 and will be transmitted through the plate-shaped fluorescent body 4. A small part 25 will pass the reflective circular polarization filter 22 and will be lost. However less optical radiation will get lost than by the lamp 1. For example, in case that the circularly polarized light beam 8 is right-handed, the part 23 of the light beam 8 reflected by the plate-shaped fluorescent body 4 will be partly right-handed and partly left-handed. The right-handed part 25 will pass the reflective circular polarization filter 22 and will be lost. The left-handed-part 24 will be reflected by the reflective circular polarization filter 22 towards the plate-shaped fluorescent body 4. By the reflective circular polarization filter 22 50% of part 23 of the light beam 8 reflected by the plate-shaped fluorescent body 4 will be reflected towards the plate-shaped fluorescent body 4.

Figure 3:
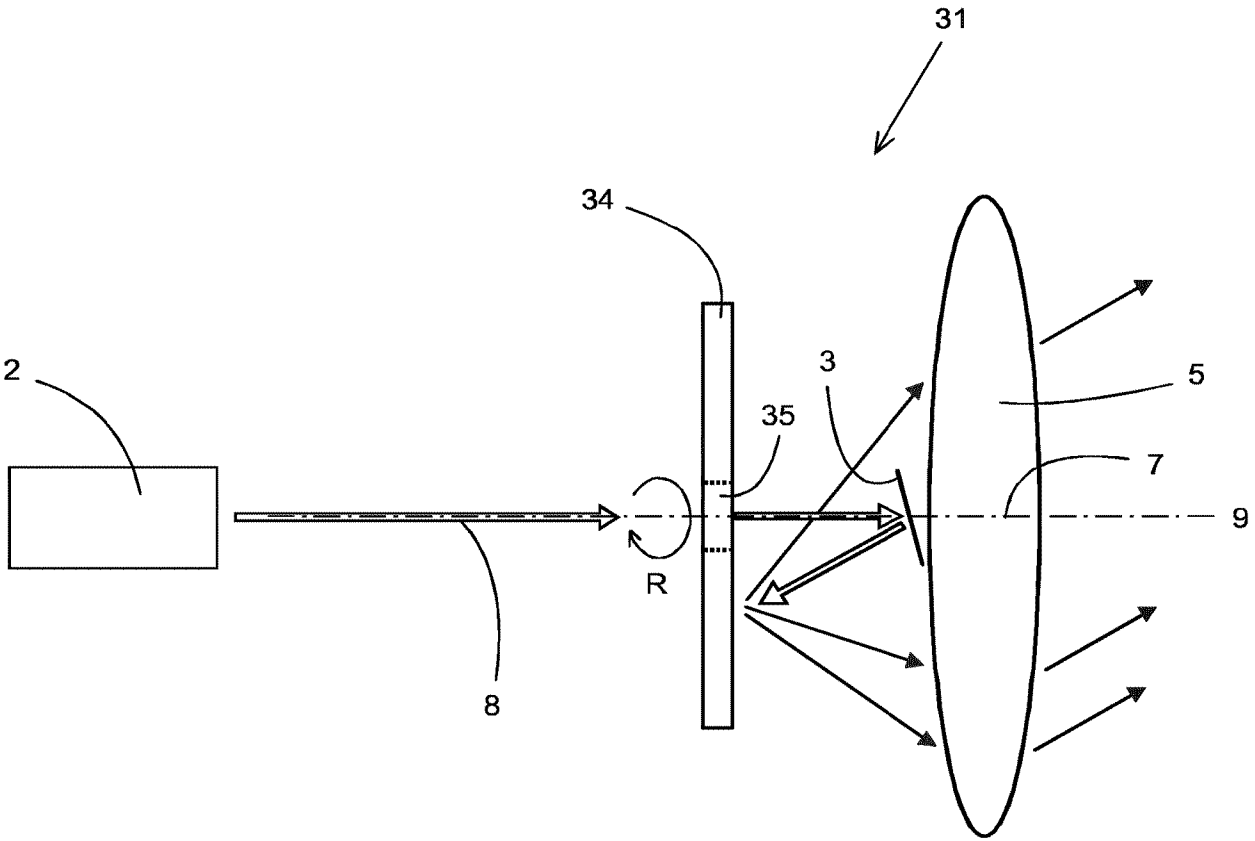
FIGS. 3-5 show a schematic views of a third, fourth and fifth embodiment of a lamp according to the invention with a reflective plate-shaped fluorescent body comprising an aperture.

FIG. 3 shows a schematic view of a third embodiment of a lamp 31 according to the invention which lamp 31 differs from lamp 1 in that it is provided with a reflective plate-shaped fluorescent body 34 comprising a central aperture 35.

The scanning mirror 3 is located near the lens 5 and near the optical axis 7.

When operating the lamp 31 the light source 2 emits optical radiation as a light beam 8. The light beam 8 passes the aperture 35 and is than directed by the scanning mirror 3 towards the desired position on reflective side of the plate-shaped fluorescent body 34. The illuminated part of the plate-shaped fluorescent body 34 is than imaged by means of the lens 5 towards the output 9 of the lamp 31.

Figure 4:
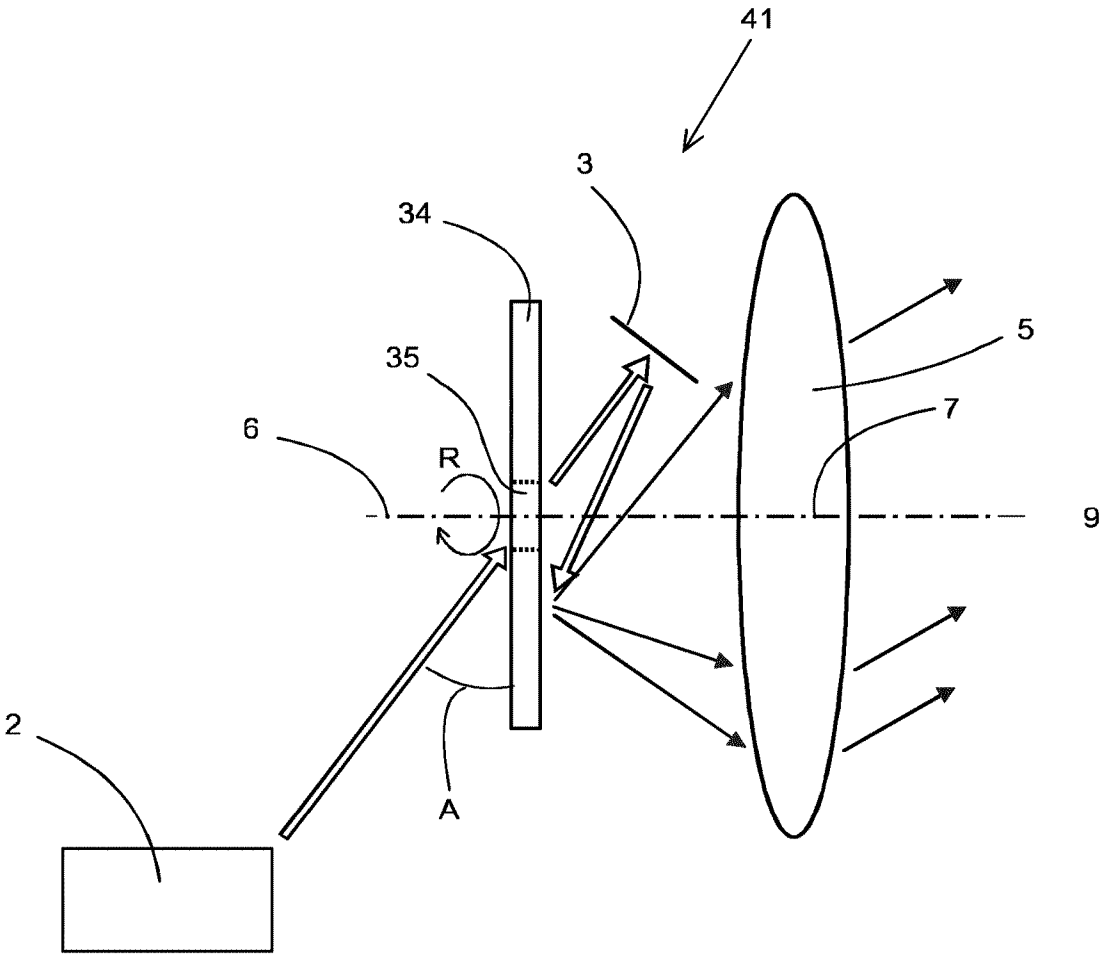

FIG. 4 shows a schematic view of a fourth embodiment of a lamp 41 according to the invention which lamp 41 differs from lamp 31 by the positions of the light source 2 and the scanning mirror 3. The light beam 8 emitted by the light source 2 encloses an angle A of about 45 degrees with the plate-shaped fluorescent body 34.

The scanning mirror 3 is located between the plate-shaped fluorescent body 34 and the lens 5 at a distance of the optical axis 7.

When operating the lamp 41 the light source 2 emits optical radiation as a light beam 8. The light beam 8 passes the aperture 35 and is than directed by the scanning mirror 3 towards the desired position on reflective side of the plate-shaped fluorescent body 34. The illuminated part of the plate-shaped fluorescent body 34 is than imaged by means of the lens 5 towards the output 9 of the lamp 41.

Figure 5:
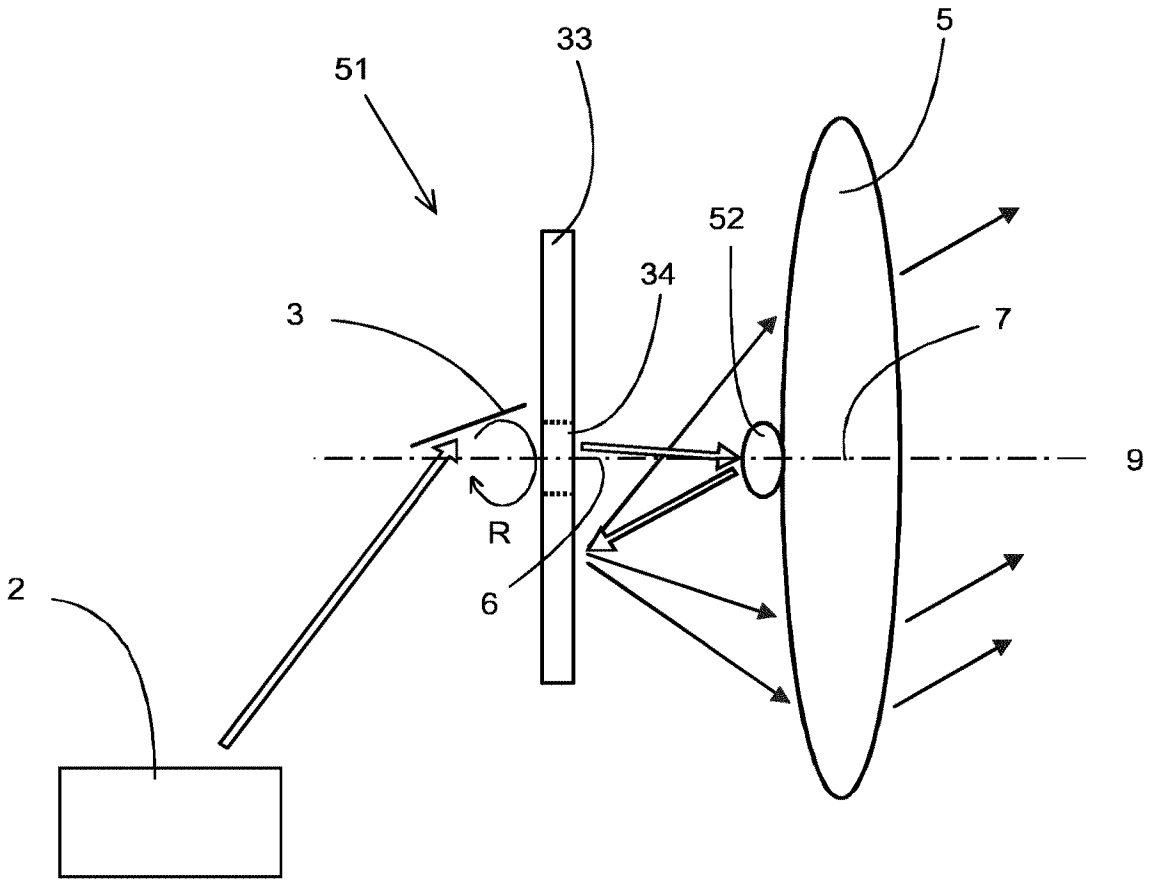

FIG. 5 shows a schematic view of a fifth embodiment of a lamp 51 according to the invention which lamp 51 differs from lamp 41 by the position of the scanning mirror 3 and an additional spherical mirror 52 near the lens 5 and near the optical axis 7 thereof. The scanning mirror 3 is located relatively close to the light source and near the aperture 35.

When operating the lamp 51 the light source 2 emits optical radiation as a light beam 8. The light beam 8 is directed by the scanning mirror 3 through the aperture 35 towards the additional spherical mirror 52. The light beam 8 is reflected by the additional spherical mirror 52 towards the desired position on reflective side of the plate-shaped fluorescent body 34. The illuminated part of the plate-shaped fluorescent body 34 is imaged by means of the lens 5 towards the output 9 of the lamp 51.

Figure 6:
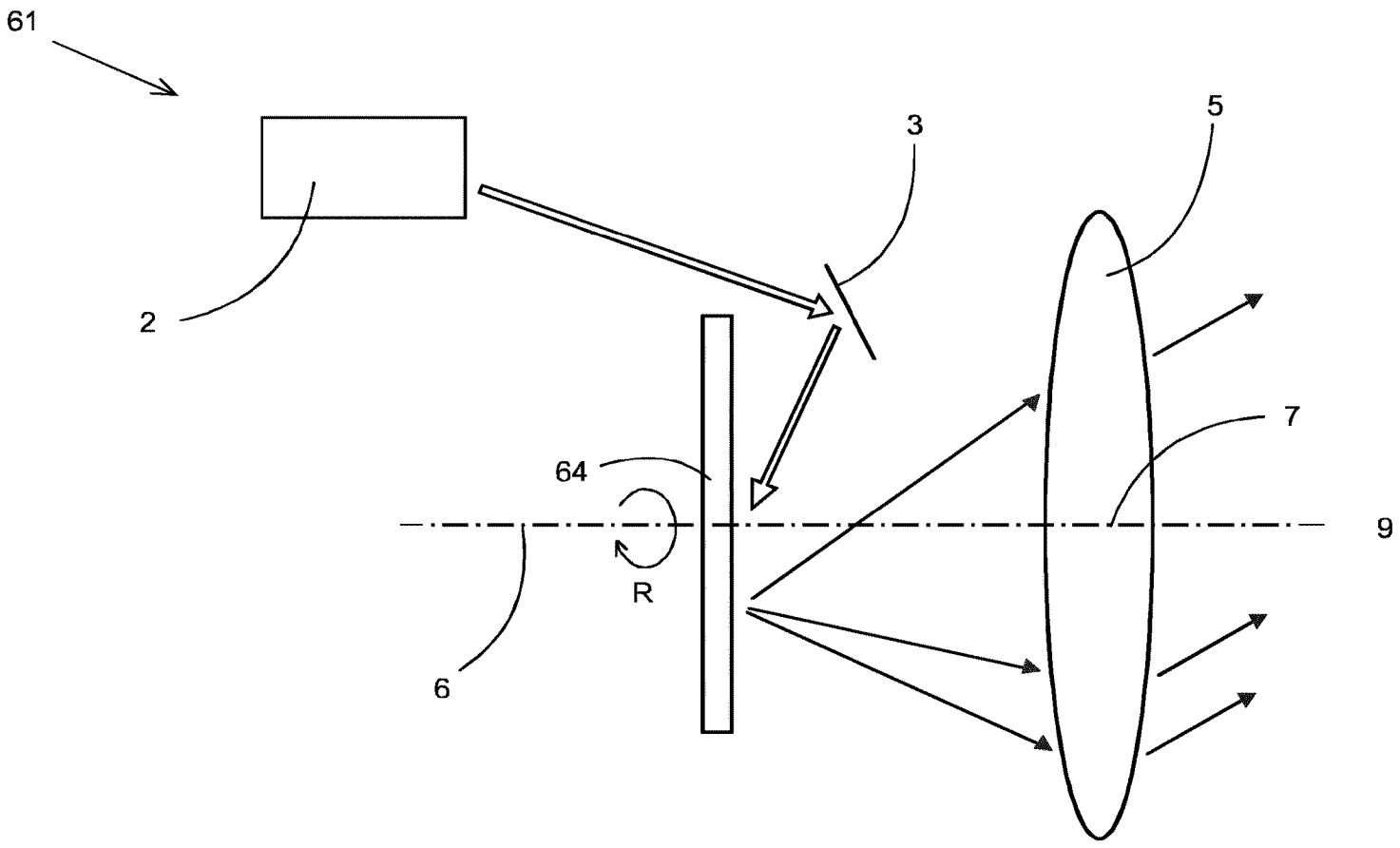
FIGS. 6 and 7 show a schematic views of a sixth and seventh embodiment of a lamp according to the invention with a reflective plate-shaped fluorescent body and no aperture.

FIG. 6 shows a schematic view of a sixth embodiment of a lamp 61 according to the invention which lamp 61 differs from lamp 1 in that the plate-shaped fluorescent body 64 is reflective instead of transmissive like the plate-shaped fluorescent body 4. Furthermore, the laser 2 and scanning mirror 3 are located in a manner to be able to direct the light beam 8 from the light source 2 via the scanning mirror 3 on the reflective side of the plate-shaped fluorescent body 64. The reflective side of the plate-shaped fluorescent body 64 is optically directed towards the lens 5. By the lamp 61 the light source 2 and the scanning mirror 3 are located on the same side of the optical axis 7 above the plate-shaped fluorescent body 64.

Figure 7:
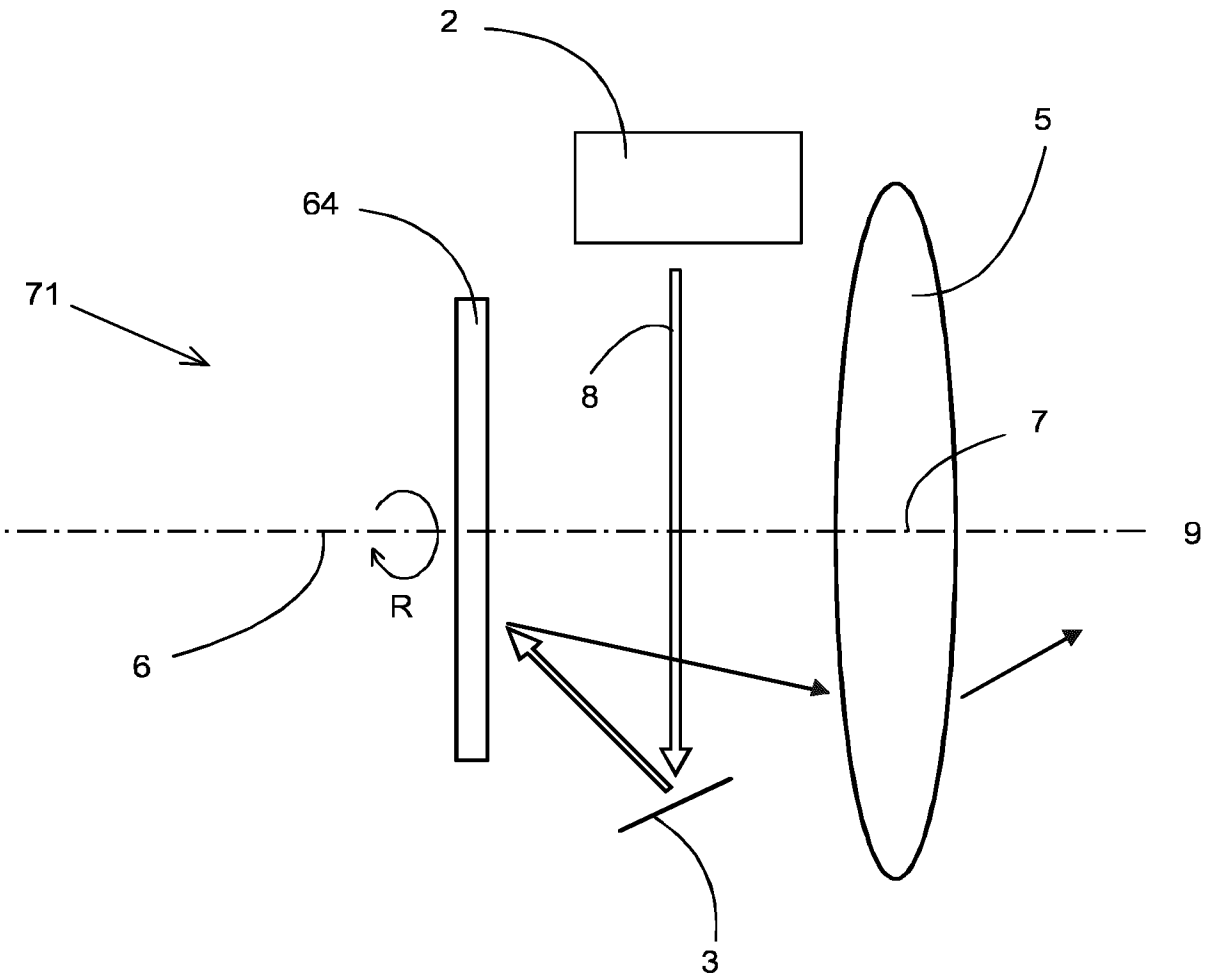

FIG. 7 shows a schematic view of a seventh embodiment of a lamp 71 according to the invention which lamp 71 differs from lamp 61 in that the light source 2 and the scanning mirror 3 are located on different sides of the optical axis 7 and the light beam 8 form the light source 2 is directed perpendicular to the optical axis 7.

The light source can also be a blue laser or a UV laser.

It is also possible that the plate-shaped fluorescent body is provided with identical phosphors over the whole plate-shaped fluorescent body.

It is also possible that the plate-shaped fluorescent body is not being rotated.

It is also possible that the light source is another very clear light sources with 1 Watt and 1 millimeter in diameter, for example a luxeon light source.

It is also possible to use more than one source, whereby the optical radiation of each light source can be directed by scanning mirrors to the desired part of the fluorescent body.

In case of that the fluorescent body 4 is not being rotated at all, the plate-shaped fluorescent body 4 can also be made of a square or rectangular plate.

The person skilled in the art will realize that the present invention is by no means limited to the preferred embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the scope should not be construed as limiting the scope of the claims.

LIST OF REFERENCE SIGNS

1 lamp
2 light source
3 scanning mirror
4 plate-shaped fluorescent body
5 lens
6 central axis
7 optical axis
8 light beam
9 output
21 lamp
22 polarization filter
23 part of light beam
24 part of light beam
25 part of light beam
31 lamp
34 plate-shaped fluorescent body
35 aperture
41 lamp
51 lamp
52 spherical mirror
61 lamp
64 plate-shaped fluorescent body
71 lamp
A angle
C control device
M1 motor
M2 motor
R arrow

The invention claimed is:

1. A lamp, comprising:

at least one light source configured to emit optical radiation, the at least one light source having a light source optical axis;

at least one scanning mirror;

a plate-shaped fluorescent body; and optical means for transmitting at least a portion of the optical radiation being directed from the at least one light source by the at least one scanning mirror onto the plate-shaped fluorescent body to an output of the lamp, wherein the optical means comprises at least one lens having a lens optical axis, wherein each part of the plate-shaped fluorescent body can be imaged by the at least one lens in a predetermined direction to the output of the lamp, wherein the plate-shaped fluorescent body is rotatable about a central axis extending perpendicular to the plate-shaped fluorescent body, and wherein the central axis coincides with the lens optical axis and the light source optical axis.

2. The lamp according to claim 1, wherein the plate-shaped fluorescent body is transmissive, whereby optical radiation from the at least one light source is being transmitted through the plate-shaped fluorescent body to the at least one lens.

3. The lamp according to claim 2, wherein a reflective polarization filter is located on a side of the plate-shaped fluorescent body optically directed towards the at least one light source.

4. The lamp according to claim 3, wherein the at least one light source is configured to emit right-handed or left-handed circularly polarized optical radiation, wherein the reflective polarization filter is a reflective circular polarization filter.

5. The lamp according to claim 2, wherein a dichroic filter is located on a side of the plate-shaped fluorescent body optically directed towards the at least one light source.

6. The lamp according to claim 1, wherein the plate-shaped fluorescent body is reflective, whereby optical radiation from the at least one light source is being reflected by the plate-shaped fluorescent body to the at least one lens.

7. The lamp according to claim 6, wherein the at least one light source is optically located on a first side of the plate-shaped fluorescent body, whilst the at least one lens is optically located on a second side of the plate-shaped fluorescent body, wherein the plate-shaped fluorescent body is provided with an aperture for guiding optical radiation emitted by the at least one light source from the first side to the second side.

8. The lamp according to claim 7, wherein the at least one scanning mirror is located between the at least one lens and the second side.

9. The lamp according to claim 7, wherein the at least one scanning mirror is located at the first side, whilst an additional mirror is located between the at least one lens and the second side.

10. The lamp according to claim 1, wherein the plate-shaped fluorescent body is provided with different phosphors in a predetermined pattern.

11. The lamp according to claim 1, wherein the at least one light source is a UV laser.

12. The lamp according to claim 1, wherein the at least one light source can be modulated in intensity.

13. The lamp according to claim 1, wherein the wavelength of the optical radiation emitted by the at least one light source is adjustable.

14. The lamp according to claim 1, wherein the lamp comprises a control device for controlling the laser, the at least one scanning mirror and/or rotation of the plate-shaped fluorescent body about the central axis extending perpendicular to the plate-shaped fluorescent body.

15. A method for using a lamp comprising the steps:

a) emitting optical radiation by a light source, b) controlling the rotation of a plate-shaped fluorescent body about a central axis, and c) transmitting at least a portion of optical radiation via at least one scanning mirror, the plate-shaped fluorescent body and at least one lens to an output of a lamp according to claim 1.

16. A lamp, comprising:

at least one light source configured to emit optical radiation;

at least one scanning mirror;

a plate-shaped fluorescent body configured to rotate about a central axis extending perpendicular to the plate-shaped fluorescent body, the at least one light source optically located on a first side of the plate-shaped fluorescent body; and optical means comprising at least one lens having an optical axis for transmitting at least a portion of the optical radiation being directed from the at least one light source by the at least one scanning mirror onto the plate-shaped fluorescent body to an output of the lamp, the at least one lens optically located on a second side of the plate-shaped fluorescent body, wherein each part of the plate-shaped fluorescent body can be imaged by the at least one lens in a predetermined direction to the output of the lamp, wherein the central axis coincides with the optical axis of the at least one lens, wherein the plate-shaped fluorescent body is reflective, whereby optical radiation from the at least one light source is being reflected by the plate-shaped fluorescent body to the at least one lens, wherein the plate-shaped fluorescent body is provided with an aperture for guiding optical radiation emitted by the at least one light source from the first side to the second side, and wherein the at least one scanning mirror is located between the at least one lens and the second side.

17. A lamp, comprising:

at least one light source configured to emit optical radiation;

at least one scanning mirror;

a plate-shaped fluorescent body configured to rotate about a central axis extending perpendicular to the plate-shaped fluorescent body, the at least one light source optically located on a first side of the plate-shaped fluorescent body; and optical means comprising at least one lens for transmitting at least a portion of the optical radiation being directed from the at least one light source by the at least one scanning mirror onto the plate-shaped fluorescent body to an output of the lamp, the at least one lens optically located on a second side of the plate-shaped fluorescent body, wherein each part of the plate-shaped fluorescent body can be imaged by the at least one lens in a predetermined direction to the output of the lamp, wherein the central axis coincides with an optical axis of the at least one lens, wherein the at least one scanning mirror is located between the at least one lens and the second side.

18. The lamp according to claim 17, wherein the at least one scanning mirror is located a distance from the optical axis of the at least one lens.

* * * * *